US011453462B2

(12) United States Patent
Martin et al.

(10) Patent No.: US 11,453,462 B2
(45) Date of Patent: Sep. 27, 2022

(54) MAGNETIC COUPLING SHADE SYSTEM FOR BOATS

(71) Applicants: Connor Martin, Newport Beach, CA (US); Garret Martin, Newport Beach, CA (US)

(72) Inventors: Connor Martin, Newport Beach, CA (US); Garret Martin, Newport Beach, CA (US)

( * ) Notice: Subject to any disclaimer, the term of this patent is extended or adjusted under 35 U.S.C. 154(b) by 439 days.

(21) Appl. No.: 16/592,668

(22) Filed: Oct. 3, 2019

(65) Prior Publication Data

US 2020/0108894 A1 Apr. 9, 2020

Related U.S. Application Data

(60) Provisional application No. 62/740,873, filed on Oct. 3, 2018.

(51) Int. Cl.
*B63B 17/02* (2006.01)

(52) U.S. Cl.
CPC ..... *B63B 17/02* (2013.01); *B63B 2221/00* (2013.01)

(58) Field of Classification Search
CPC ..... E04H 15/64; B63B 17/02
See application file for complete search history.

(56) References Cited

U.S. PATENT DOCUMENTS 2,639,751 A * 5/1953 Flaherty ..... B60J 11/00 296/136.03
3,763,908 A * 10/1973 Norman ..... B60J 11/00 150/166
3,805,872 A * 4/1974 Lorber ..... E06B 9/52 160/354
4,940,009 A * 7/1990 Keithley, Jr. ..... B63B 17/02 296/100.18
5,277,214 A * 1/1994 Tolley ..... E04H 15/06 135/117
5,738,130 A * 4/1998 Thomas ..... E04H 15/06 135/88.13
5,806,906 A * 9/1998 Hammond ..... B60J 1/2011 296/165
6,050,280 A * 4/2000 Jeske ..... E04H 15/08 135/117
8,267,105 B1 * 9/2012 Denmark, Jr. ..... E04F 10/04 135/88.13

(Continued)

*Primary Examiner* — Noah Chandler Hawk
(74) *Attorney, Agent, or Firm* — Rutan & Tucker LLP; Ravi Mohan

(57) ABSTRACT

Systems and methods are provided for a magnetic coupling shade system for boats. The magnetic coupling shade system features a sheet of material that includes magnetic portions coupled with magnets disposed in locations of a boat. The locations of the boat include any of the hull, deck, superstructure, hardtop, or any other suitable surface of the boat. Magnets located on the hull are located within the interior of the hull. The sheet extends from the top to either or both of the port and starboard sides. The sheet can include a variety of materials, and a window portion for viewing through the sheet. In some embodiments, the window portion includes an entirety of the sheet with the magnetic portions attached to opposite edges of the window portion. The sheet is configured to be detached from the magnets and either suspended overhead or rolled upward when not in use.

21 Claims, 4 Drawing Sheets

(56) References Cited

U.S. PATENT DOCUMENTS

| | | | | |
|---|---|---|---|---|
| 9,198,482 | B2 * | 12/2015 | Fietsam | A44B 17/00 |
| 9,428,039 | B2 * | 8/2016 | Sassi | B60J 11/02 |
| 9,637,203 | B1 * | 5/2017 | Kirwan-Waterson | B63B 17/02 |
| 9,834,951 | B1 * | 12/2017 | Townley | B60J 5/101 |
| 2008/0121349 | A1 * | 5/2008 | De La Cruz | B66B 13/303 160/23.1 |
| 2020/0062091 | A1 * | 2/2020 | Kao | B60J 7/0015 |

* cited by examiner

MAGNETIC COUPLING SHADE SYSTEM FOR BOATS

PRIORITY

This application claims the benefit of priority to U.S. Provisional Patent Application No. 62/740,873, filed Oct. 3, 2018, titled "Magnetic Coupling System for Boats," which is hereby incorporated by reference into this application in its entirety.

FIELD

Embodiments of the present disclosure generally relate to the field of convertible boat covers. More specifically, embodiments of the disclosure relate to magnetic coupling systems and methods for providing unobstructed protection to boat passengers from environmental hazards.

BACKGROUND

In recreational boating, a "Bimini top" is a convertible boat cover that may be erected above the deck of a boat at an elevation comfortably above the heads of passengers. Bimini tops and other convertible boat covers generally are used by boaters to provide shade and limit exposure to the strong rays of the tropical sun. Convertible boat covers generally comprise a flexible canvas material secured to a foldable support frame that may be erected across the deck. Typically, convertible boat covers are pivotally attached to the deck such that the covers can be raised when needed or lowered into a substantially flat position on the deck when not in use. Deployment of foldable boat covers is often done manually but has been designed to be power driven, as well. As will be appreciated, the use of convertible boat covers, such as the Bimini top, have become increasingly popular due to a desire to protect boat passengers from an evident risk of skin cancer that may be caused by excessive sun exposure.

A typical convertible boat cover comprises rigid pole members mounted to the port and starboard sides of the boat and configured to extend across the deck at a height suitable to support the canvas material overhead. In some instances, the canvas material may include side sheet portions that include clear vinyl windows and extend from the top to the sides of the boat so as to provide shelter to occupants from wind, water mist, and reflected sunlight. A drawback to such side sheet portions, however, is that they typically are fastened to the hull of the boat and thus obstruct occupants from reaching out over the sides of the boat when fishing, docking or mooring the boat and may present a further obstacle during boarding and loading equipment onto the deck. Accordingly, there is a continuing desire to develop convertible boat covers that are capable of protecting occupants from environmental hazards, such as sun exposure, without obstructing occupants reaching over the side of the boat.

SUMMARY

Systems and methods for magnetic coupling shade system for boats in accordance with embodiments of the invention are disclosed. In one embodiment, a magnetic shade system for boats, comprises a sheet of material including one or more magnetic portions and configured to extend from the top to the side of a boat, a multiplicity of magnets configured to be coupled with locations of the boat, and a window portion of the sheet configured to enable viewing through the sheet.

In a further embodiment, the sheet is configured to extend from a port side of the boat, over the top of the boat, to a starboard side of the boat.

In another embodiment, at least one of the one or more magnetic portions is configured to magnetically attach to one or more of the multiplicity of magnets coupled with the port side, and at least one of the one or more magnetic portions is configured to magnetically attach to one or more of the multiplicity of magnets coupled with the starboard side.

In a still further embodiment, the one or more of the multiplicity of magnets are configured to attach the sheet to an exterior of the port side and the starboard side of the hull of the boat.

In a yet further embodiment, the sheet is configured to be attached to either a port side or a starboard side of the top of the boat and extend respectively to the port side or the starboard side of the hull of the boat.

In yet another embodiment, at least one of the one or more magnetic portions is configured to magnetically attach to one or more of the multiplicity of magnets coupled with the port side or the starboard side of the hull.

In a further embodiment again, the sheet is configured to be detached from the port side or the starboard side of the hull and suspended along an underside of the top of the boat in an overhead configuration.

In another embodiment again, one or more of the multiplicity of magnets are disposed in the top of the boat so as to maintain the sheet in the overhead configuration.

In a further additional embodiment, the sheet is attached to an interior of either the port side or the starboard side of the top by way of suitable fasteners.

In another additional embodiment, the sheet is attached to an interior of either the port side or the starboard side of the top by way of a roller blind system configured to retract the sheet into a rolled-up, retraced configuration.

In a still yet further embodiment, the one or more magnetic portions comprise magnetic strips disposed along a front side and a rear side of the sheet, the magnetic strips being configured to facilitate retracting the sheet.

In still yet another embodiment, the one or more magnetic portions comprise magnetic strips disposed along opposite sides of the sheet, the magnetic strips being configured to magnetically attach to the multiplicity of magnets.

In a still further embodiment, the magnetic strips are disposed along a front side and a rear side of the sheet.

In a still further additional embodiment, the locations of the boat include the hull, deck, superstructure, hardtop, or any other suitable surface of the boat.

In still another additional embodiment, one or more of the multiplicity of magnets are disposed in locations of the boat suitable for magnetically attaching any of various accessories.

In a variety of embodiments, a magnetic shade system for boats includes a sheet of material including one or more magnetic portions and configured to extend from the top to the side of a boat, a roller blind system coupled with an underside of the top and configured to suspend the sheet from the top to the side of the boat, and a multiplicity of magnets configured to be coupled with locations of the boat.

In more embodiments, the sheet includes a window portion configured to enable viewing through the sheet.

In a yet further embodiment, the window portion comprises an entirety of the sheet, the one or more magnetic portions being attached to suitable edges of the window portion.

In yet another additional embodiment, the roller blind system is coupled with an interior of either the port side or the starboard side of the top and configured to retract the sheet into a rolled-up, retracted configuration.

In a further additional embodiment again, the one or more magnetic portions comprise magnetic strips disposed along a front side and a rear side of the sheet, the magnetic strips being configured to maintain the rolled-up, retracted configuration.

In many embodiments, a magnetic shade system for boats includes a sheet of material including one or more magnetic portions and configured to extend from the top to the side of a boat, a multiplicity of magnets configured to be coupled with locations of the boat the locations of the boat comprise areas of the hull with a magnet placed within the interior of the hull of the boat directly underneath the area of the hull to be coupled, and a window portion of the sheet configured to enable viewing through the sheet.

BRIEF DESCRIPTION OF THE DRAWINGS

The drawings refer to embodiments of the present disclosure in which.

Figure 1:
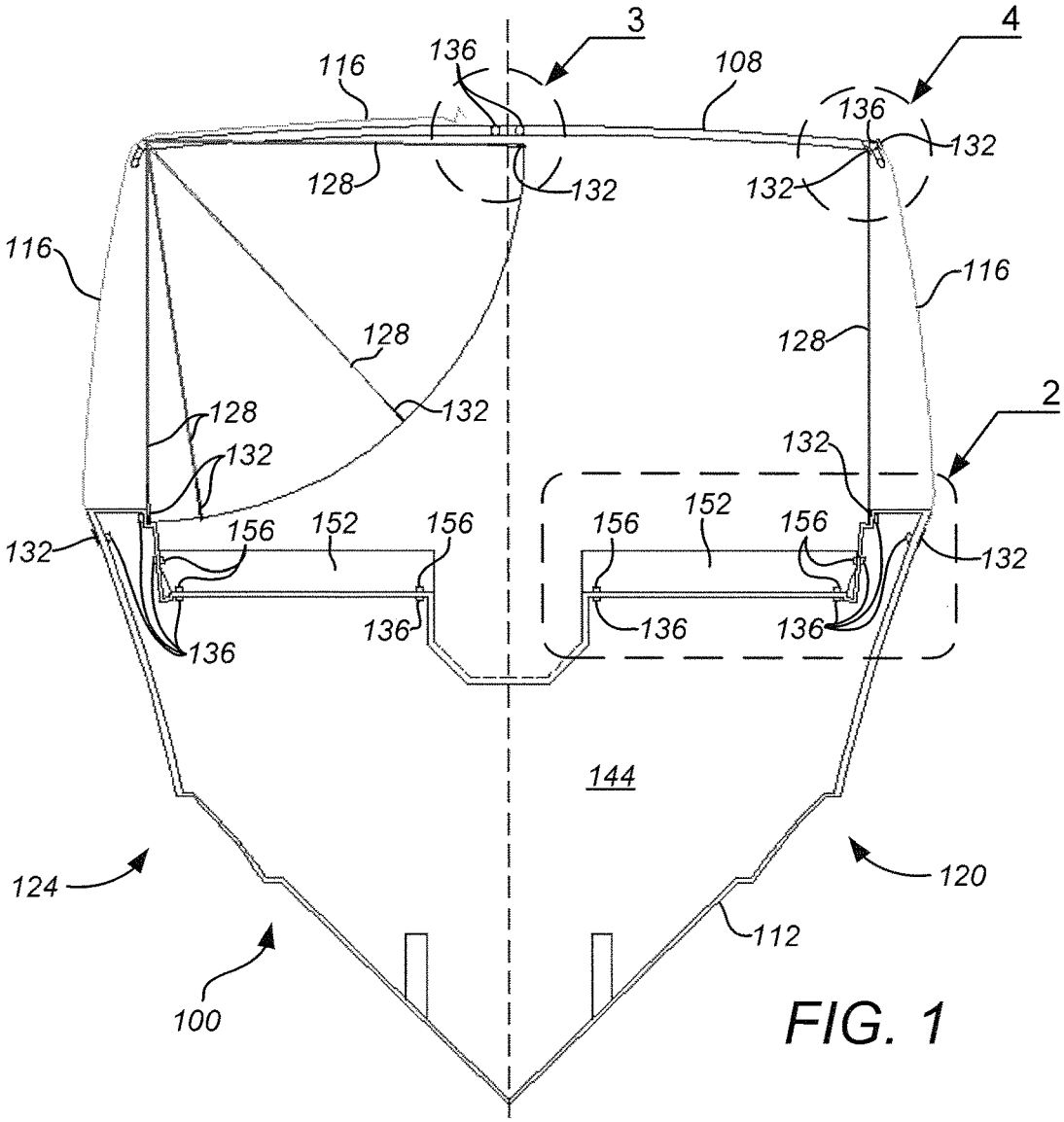
FIG. 1 illustrates a cross-sectional view of a boat that includes an exemplary embodiment of a magnetic shade system, in accordance with the present disclosure.

While the present disclosure is subject to various modifications and alternative forms, specific embodiments thereof have been shown by way of example in the drawings and will herein be described in detail. The invention should be understood to not be limited to the particular forms disclosed, but on the contrary, the intention is to cover all modifications, equivalents, and alternatives falling within the spirit and scope of the present disclosure.

DETAILED DESCRIPTION

In the following description, numerous specific details are set forth in order to provide a thorough understanding of the present disclosure. It will be apparent, however, to one of ordinary skill in the art that the invention disclosed herein may be practiced without these specific details. In other instances, specific numeric references such as "first magnet," may be made. However, the specific numeric reference should not be interpreted as a literal sequential order but rather interpreted that the "first magnet" is different than a "second magnet." Thus, the specific details set forth are merely exemplary. The specific details may be varied from and still be contemplated to be within the spirit and scope of the present disclosure. The tem' "coupled" is defined as meaning connected either directly to the component or indirectly to the component through another component. Further, as used herein, the terms "about," "approximately," or "substantially" for any numerical values or ranges indicate a suitable dimensional tolerance that allows the part or collection of components to function for its intended purpose as described herein.

In general, the present disclosure describes systems and methods for magnetic shades for boats. The magnetic shade system comprises a sheet of material that includes magnetic portions that may be coupled with magnets disposed in locations of a boat. The types of magnets utilized may include temporary and/or permanent magnets, electromagnets, and can comprise materials including neodymium, ceramic, alnico. In certain embodiments, polymagnets (or other suitable multi-pole magnet) can be utilized to create attachment at certain positions and/or rotations that can include positioning to facilitate proper placement of shades, cushion seats, and/or pocket doors. Printed magnets may also be utilized in various embodiments depending on the application desired.

The locations of the boat that may be suitable to place magnetic materials include any of the hull, deck, superstructure, hardtop, or any other suitable surface of the boat. The sheet can be configured to extend from the top to at least either the port side or the starboard side of the boat. The sheet material can be comprised of various materials including, but not limited to, Eisenglass, Strataglass, canvas, bug screen, upholstery, or other similar material. In many embodiments, the sheet can include a window portion configured to enable viewing through the sheet. In some embodiments, the window portion comprises the substantial majority of the sheet with the exception of the magnetic portions being attached to opposing edges. The sheet can be configured to detach from the magnets and either be suspended overhead or retracted into a rolled-up configuration when not in use.

FIG. 1 illustrates a cross-sectional view of a boat 100 that includes an exemplary embodiment of a magnetic shade system, in accordance with the present disclosure. The magnetic shade system generally comprises a sheet of material that is configured to extend from a top 108 of the boat 100 to a side of a hull 112 of the boat. FIG. 1 shows two exemplary embodiments of the sheet that may be incorporated into the magnetic shade system, without limitation. In one embodiment, an exterior sheet 116 is configured to extend from a port side 120 of the boat 100, over the top 108, to a starboard side 124 of the boat 100. In another embodiment, an interior sheet 128 is configured to be attached to each of the port side 120 and the starboard side 124 of the top 108 of the boat 100 and extend respectively to the port side or the starboard side of the hull 112. In these embodiments, the interior sheets 128 can be separate sheets or can be have a tether to each other utilized for placement and/or anchoring to the boat 100.

In some embodiments, the exterior and interior sheets 116, 128 may be used in combination. For example, in some embodiments, the exterior sheet 116 is configured to allow high visibility and protect occupants of the boat 100 from insects while the interior sheet 128 is configured to block reflected sunlight and/or wind from reaching the occupants. Further, the exterior and interior sheets 116, 128 can include, in some embodiments, a window portion configured to enable viewing through the sheets. It will be understood by those skilled in the art that a variety of combinations of interior and exterior sheet materials can be utilized, including multiple materials on a single sheet, depending on the application desired. By way of example and not limitation, the interior sheet 116 may include a window portion comprising a flap of sheet material that is attached to the sheet 116, such as by way of Velcro, and may be detached by a practitioner when increased visibility is desired. It is envisioned, therefore, that the exterior and interior sheets 116, 128 generally can be comprised of any of Eisenglass, Strataglass (or any other suitable clear vinyl), canvas, bug screen, upholstery, or any combination thereof, as desired and without limitation.

Figure 2:
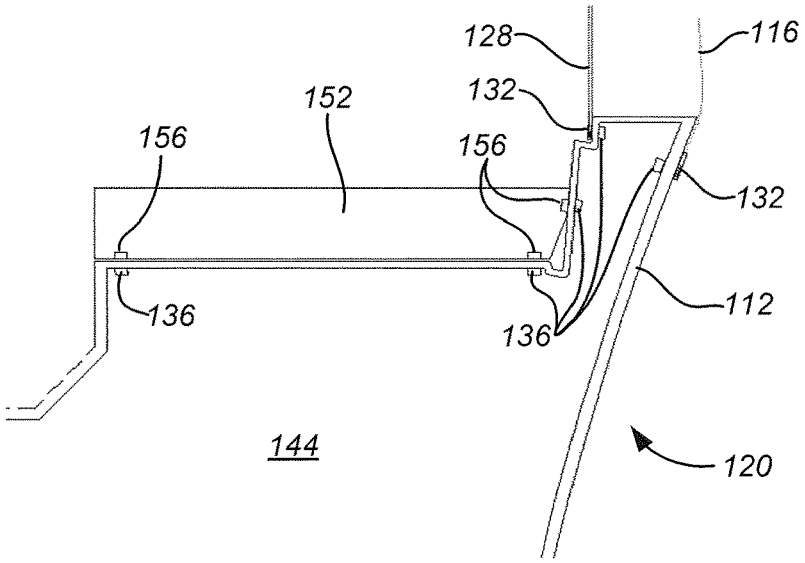
FIG. 2 illustrates a close-up view of a port side of a boat including an exemplary embodiment of a magnetic shade system according to the present disclosure.

As shown in FIG. 1, the exterior and interior sheets 116, 128 are configured to be extended along the port and starboard sides 120, 124 and/or the top 108 of the boat 100, as described above. As such, the exterior and interior sheets 116, 128 include magnetic portions 132 that can be magnetically attached to a multiplicity of magnets 136 that are coupled with various locations of the boat 100, such as, by way of non-limiting example, the hull, deck, superstructure, hardtop, or any other suitable surface of the boat. As best shown in FIG. 2, in one embodiment, the magnets 136 are disposed within an interior 144 of the boat 100 and attached to an inside surface of the hull 112 to enable the sheets 116, 128 to be attached directly onto exterior portions of the hull 112. In such embodiments, the magnets 136 can remain hidden from view, thereby maintaining an aesthetically appealing appearance of the boat 100.

In some embodiments, wherein the exterior sheet 116 extends over the top 108 of the boat 100, magnetic portions 132 disposed on opposite ends of the sheet 116 are configured to magnetically attach to one or more magnets 136 coupled with the port side 120 and one or more magnets 136 coupled with the starboard side 124. As shown in FIGS. 1-2, the magnets 136 may be disposed within the interior 144 such that the sheet 116 can be magnetically attached to the exterior of the port and starboard sides 120, 124 of the hull 112 of the boat 100. Further, in some embodiments, wherein the interior sheet 128 extends from the port side 120 or the starboard side 124 of the top 108, the magnetic portions 132 may be configured to magnetically attach to magnets 136 coupled respectively with the port side 120 or the starboard side 128 of the hull 112. As best shown in FIG. 2, the magnets 136 may be disposed within the interior 144 in locations that couple the interior sheet 128 inside the hull 112. As discussed herein, coupling the interior sheet 128 inside the hull 112 may facilitate moving the interior sheet 128 to a suspended, overhead configuration when the sheet is not in use.

Figure 6:
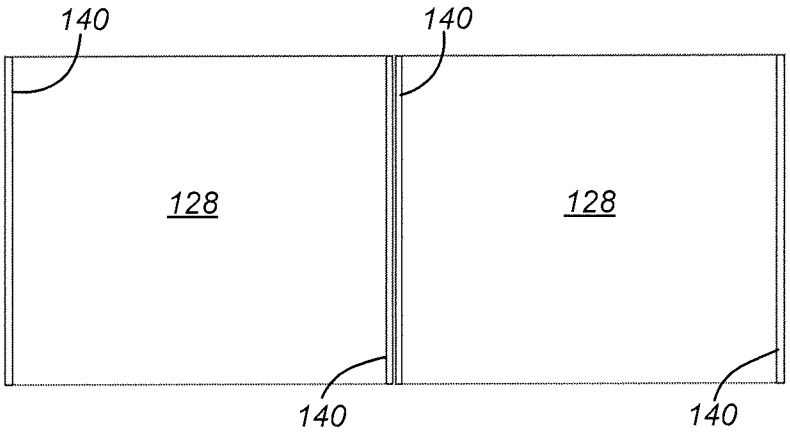
FIG. 6 illustrates a side view of an exemplary embodiment of an interior sheet comprising a magnetic shade system that may be coupled with a roller blind system, according to the present disclosure.

The magnetic portions 132 may include any configuration or shape of magnet that is found to be advantageous for attaching the sheets 116, 128 to the boat 100. For example, the magnetic portions 132 may be magnetic disks that are woven or molded into the materials comprising the sheets 116, 128. Further, as shown in FIG. 6, some embodiments of the magnetic portions 132 may comprise magnetic strips 140. In the illustrated embodiment of FIG. 6, the magnetic strips 140 may be disposed along front and rear sides of the interior sheet 128 and configured to magnetically attach to the magnets 136. In some embodiments, wherein a roller blind system is implemented for retracting the interior sheet 128, the magnetic strips 140 may maintain the interior sheet 128 in a rolled-up, retracted configuration when not in use, as described herein.

Figure 3:
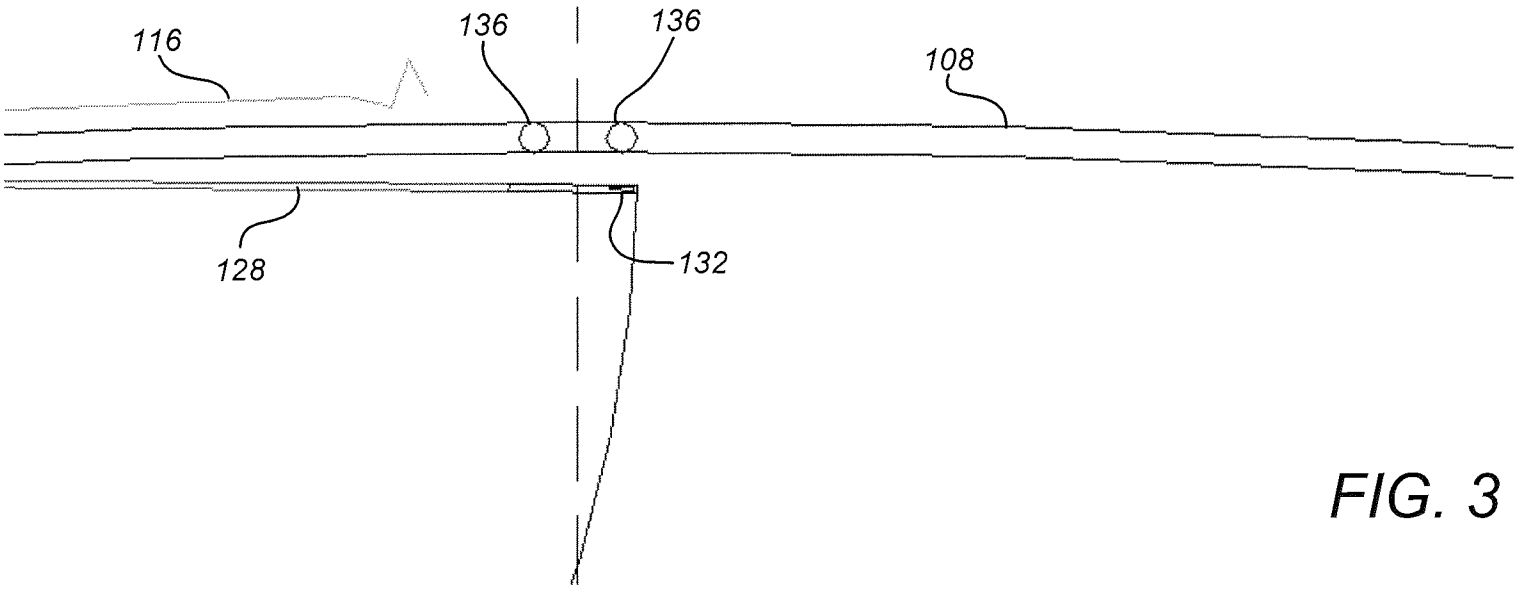
FIG. 3 illustrates a close-up cross-sectional view of a top of a boat that includes magnets for suspending a magnetic shade system in an overhead configuration.

With reference again to FIG. 1, in further embodiments, the interior sheet 128 is configured to be detached from the magnets 136 in the port side 120, or the starboard side 124, of the hull 112 and suspended along an underside of the top 108 of the boat 100 in an overhead configuration. As best shown in FIG. 3, one or more of the magnets 136 may be disposed in the top 108 so as to maintain the interior sheet 128 in the overhead configuration. As will be appreciated, placing the interior sheet 128 into the overhead configuration facilitates improved visibility when protection from exposure to sunlight is not desired.

Figure 4:
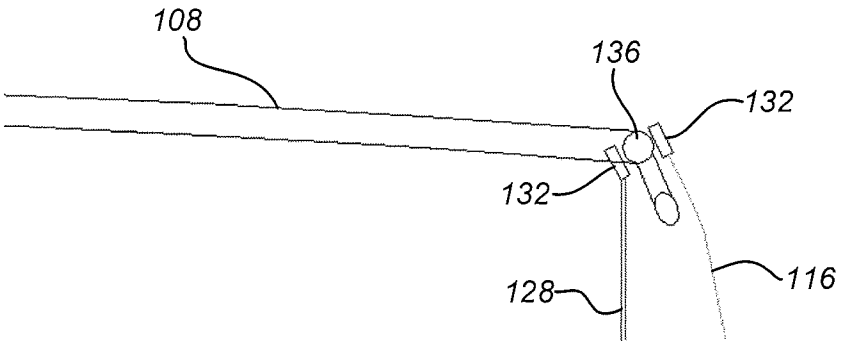
FIG. 4 illustrates a close-up cross-sectional view of a port side of a top of a boat that includes magnets for suspending a magnetic shade system along the port side of the boat.

With reference to FIG. 4, in some embodiments, the interior sheet 128 may be attached to an interior of either the port side 120 or the starboard side 124 of the top 108 by way of any technique that enables moving the interior sheet 128 to the overhead configuration, as described herein. For example, magnets 136 may be coupled with portions of the top 108 so as to magnetically attach the magnetic portions 132 of the sheet 128 to the top 108, as shown in FIG. 4. Further, in some embodiments, the exterior sheet 116 may be magnetically attached to magnets 136 coupled with the top 108.

Figure 5:
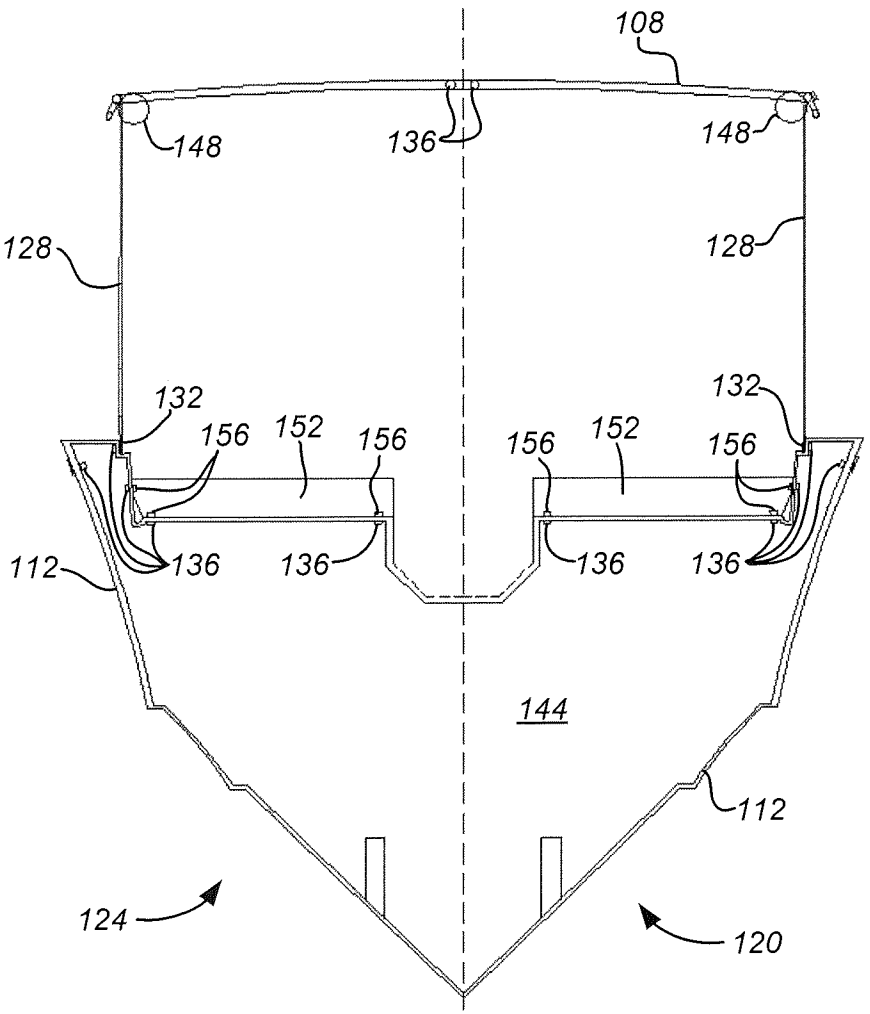
FIG. 5 illustrates a cross-sectional view of a boat that includes an exemplary embodiment of a magnetic shade system that includes a roller blind system, in accordance with the present disclosure.

In some embodiments, any of various suitable fasteners or devices may be utilized to fixedly attach either of the sheets 116, 128 to the top 108. For example, in an embodiment illustrated in FIG. 5, a roller blind system 148 is coupled with an underside of the top 108 and oriented along the port and starboard sides 120, 124 of the top 108. The roller blind system 148 is configured suspend the interior sheets 128 along the port and starboard sides 120, 124 of the boat 100. As will be appreciated, the roller blind system 148 is further configured to retract the interior sheets 128 into a rolled-up, retracted configuration when greater visibility is desired. Furthermore, in some embodiments, the magnetic portions 132 may comprise the magnetic strips 140, discussed with reference to FIG. 6, disposed along front and rear sides of the interior sheets 128. It is contemplated that the magnetic strips 140 can advantageously facilitate rolling up the interior sheets 128, as well as desirably maintaining the rolled-up, retracted configuration of the interior sheets 128.

It is contemplated that the magnets 136 are not limited to attaching the exterior and interior sheets 116, 128 to the hull 112, but rather the magnets 136 may be used to attach any of various accessories to locations of the boat 100, as desired. In various embodiments, one or more seat cushions 152 may be magnetically coupled with the boat 100. As shown in FIGS. 1 and 2, the seat cushions 152 may include seat magnetic portions 156 that are disposed in locations of the seat cushions 152 that align with magnets 136 disposed within the interior 144. Thus, the seat cushions 152 may be magnetically fixated in optimal locations upon merely placing the seat cushions 152 onto the areas of the boat 100 that include the magnets 136. In certain embodiments, the magnets 136 can be disposed in locations such that the inner or outer sheets 116, 128 and/or the seat cushions 152 can be attached. It should be recognized, therefore, that one or more magnets, such as the magnets 136, may be disposed in any of various locations of the boat 100, other than those locations discussed herein, for the purpose of magnetically attaching any of various accessories that is desired to be fixated during movement of the boat due to water and wind forces.

Figure 7A:
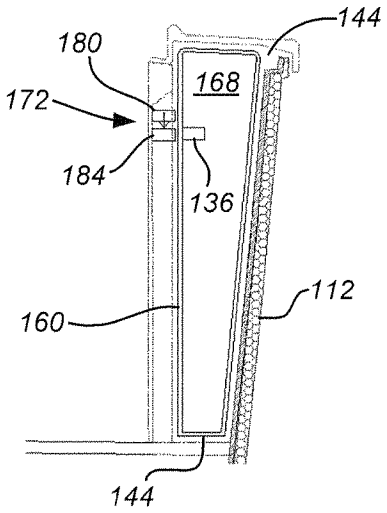
FIG. 7A illustrates a cross-sectional view of a pocket door comprising a magnet latch and recessed within an interior of a boat hull, according to the present disclosure.
Figure 7B:
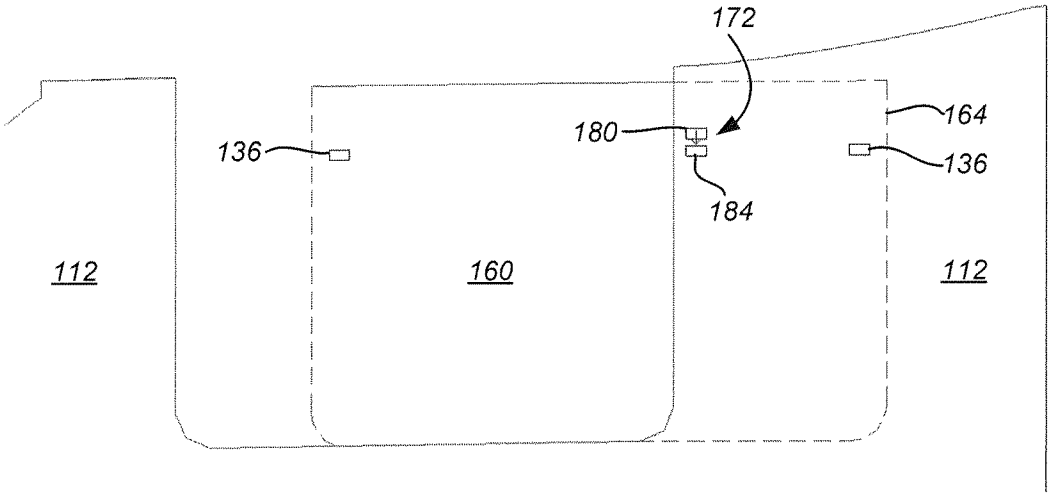
FIG. 7B illustrates a side ghost-view of the pocket door of FIG. 7A, showing magnets that are configured to hold the pocket door in an open position or a closed position, in accordance with the present disclosure.

In an embodiment illustrated in FIGS. 7A and 7B, the magnets 136 can be used to facilitate the operation of a pocket door 160. The pocket door 160 can be slidably coupled to the hull 112, such that the door 160 recesses into the interior 144 of the hull 112 when the door 160 is opened, as shown in FIG. 7B. As such, the pocket door 160 includes a recessed portion 164 that remains housed within the interior 144 of the hull 112 and facilitates the door 160 moving between an open position and a closed position. In the embodiment illustrated in FIG. 7B, magnets 136 are fixed in an interior cavity 168 of the pocket door 160 near opposite edges of the door. It is contemplated that the magnets 136 are positioned within the interior cavity 168 so as to magnetically communicate with a magnetic latch 172 disposed within the interior 144 of the hull 112 adjacent to the door 160. In the illustrated embodiment, the magnetic latch 172 includes a single magnet that is moveable vertically between an unlocked position 180 and a locked position 184. As will be appreciated, moving the magnetic latch 172 into the unlocked position 180 allows the magnets 136 to pass by the magnetic latch 172 with relatively little magnetic attraction. In the locked position 184, however, the magnetic latch 172 strongly attracts the magnets 136, thereby holding the pocket door 160 either in the open position or in the closed position. It is envisioned, therefore, that the pocket door 160 may be moved between the open position and the closed position upon first moving the magnetic latch 172 to the unlocked position 180 and then moving the pocket door 160 as desired. It should also be apparent to those skilled in the art that the positioning of the magnets on the pocket door 160 can be configured to create magnetic communication between the magnets 136 in both the open and locked positions.

While the invention has been described in terms of particular variations and illustrative figures, those of ordinary skill in the art will recognize that the invention is not limited to the variations or figures described. In addition, where methods and steps described above indicate certain events occurring in certain order, those of ordinary skill in the art will recognize that the ordering of certain steps may be modified and that such modifications are in accordance with the variations of the invention. Additionally, certain of the steps may be performed concurrently in a parallel process when possible, as well as performed sequentially as described above. To the extent there are variations of the invention, which are within the spirit of the disclosure or equivalent to the inventions found in the claims, it is the intent that this patent will cover those variations as well. Therefore, the present disclosure is to be understood as not limited by the specific embodiments described herein, but only by scope of the appended claims.

What is claimed is:

1. A magnetic shade system for boats, comprising:

a sheet of material including one or more magnetic portions, wherein the sheet of material is configured to extend from the top to the side of a boat;

a multiplicity of magnets coupled with one or more locations of the boat;

the one or more locations of the boat comprising any of a hull, deck, superstructure, and hardtop;

a window portion of the sheet configured to enable viewing through the sheet;

wherein the magnets facilitate operation of a pocket door slidably coupled to the hull, the pocket the door comprising a recessed portion, wherein the pocket door is configured to recess into an interior of the hull when the pocket door is opened; and wherein the magnets are positioned to magnetically communicate with a magnetic latch disposed within the interior of the hull.

2. The magnetic shade system of claim 1, wherein the sheet is configured to extend from a port side of the boat, over the top of the boat, to a starboard side of the boat.

3. The magnetic shade system of claim 2, wherein at least one of the one or more magnetic portions is configured to magnetically attach to one or more of the multiplicity of magnets coupled with the port side, and wherein at least one of the one or more magnetic portions is configured to magnetically attach to one or more of the multiplicity of magnets coupled with the starboard side.

4. The magnetic shade system of claim 3, wherein the one or more of the multiplicity of magnets are configured to attach the sheet to an exterior of the port side and the starboard side of the hull of the boat.

5. The magnetic shade system of claim 1, wherein the sheet is configured to be attached to either a port side or a starboard side of the top of the boat and extend respectively to the port side or the starboard side of the hull of the boat.

6. The magnetic shade system of claim 5, wherein at least one of the one or more magnetic portions is configured to magnetically attach to one or more of the multiplicity of magnets coupled with the port side or the starboard side of the hull.

7. The magnetic shade system of claim 6, wherein the sheet is configured to be detached from the port side or the starboard side of the hull and suspended along an underside of the top of the boat in an overhead configuration.

8. The magnetic shade system of claim 7, wherein one or more of the multiplicity of magnets are disposed in the top of the boat so as to maintain the sheet in the overhead configuration.

9. The magnetic shade system of claim 5, wherein the sheet is attached to an interior of either the port side or the starboard side of the top by way of suitable fasteners.

10. The magnetic shade system of claim 5, wherein the sheet is attached to an interior of either the port side or the starboard side of the top by way of a roller blind system configured to retract the sheet into a rolled-up, retraced configuration.

11. The magnetic shade system of claim 10, wherein the one or more magnetic portions comprise magnetic strips disposed along a front side and a rear side of the sheet, the magnetic strips being configured to facilitate retracting the sheet.

12. The magnetic shade system of claim 1, wherein the one or more magnetic portions comprise magnetic strips disposed along opposite sides of the sheet, the magnetic strips being configured to magnetically attach to the multiplicity of magnets.

13. The magnetic shade system of claim 12, wherein the magnetic strips are disposed along a front side and a rear side of the sheet.

14. The magnetic shade system of claim 1, wherein the locations of the boat include the hull, deck, superstructure, hardtop, or any other suitable surface of the boat.

15. The magnetic shade system of claim 1, wherein one or more of the multiplicity of magnets are disposed in locations of the boat suitable for magnetically attaching any of various accessories.

16. A magnetic shade system for boats, comprising:

a sheet of material including one or more magnetic portions and configured to extend from the top to the side of a boat;

a roller blind system coupled with an underside of the top and configured to suspend the sheet from the top to the side of the boat;

a multiplicity of magnets configured to be coupled with locations of the boat comprising any of a hull, deck, superstructure, and hardtop;

wherein the multiplicity of magnets facilitate operation of a pocket door slidably coupled to the hull, the pocket the door comprising a recessed portion, wherein the pocket door is configured to recess into an interior of the hull when the pocket door is opened; and wherein the magnets are positioned to magnetically communicate with a magnetic latch disposed within the interior of the hull.

17. The magnetic shade system of claim 16, wherein the sheet includes a window portion configured to enable viewing through the sheet.

18. The magnetic shade system of claim 17, wherein the window portion comprises an entirety of the sheet, the one or more magnetic portions being attached to suitable edges of the window portion.

19. The magnetic shade system of claim 16, wherein the roller blind system is coupled with an interior of either the port side or the starboard side of the top and configured to retract the sheet into a rolled-up, retracted configuration.

20. The magnetic shade system of claim 19, wherein the one or more magnetic portions comprise magnetic strips disposed along a front side and a rear side of the sheet, the magnetic strips being configured to maintain the rolled-up, retracted configuration.

21. A magnetic shade system for boats, comprising:

a sheet of material including one or more magnetic portions and configured to extend from the top to the side of a boat;

a multiplicity of magnets configured to be coupled with locations of the boat wherein the locations of the boat comprise areas of the hull with a magnet placed within the interior of the hull of the boat directly underneath the area of the hull to be coupled;

a window portion of the sheet configured to enable viewing through the sheet;

wherein the multiplicity of magnets facilitate operation of a pocket door slidably coupled to the hull, the pocket the door comprising a recessed portion, wherein the pocket door is configured to recess into an interior of the hull when the pocket door is opened; and wherein the magnets are positioned to interface with a magnetic latch disposed within the interior of the hull.

* * * * *